US010723205B2

(12) United States Patent
Ito et al.

(10) Patent No.: US 10,723,205 B2
(45) Date of Patent: Jul. 28, 2020

(54) REGISTER FOR AIR-CONDITIONING

(71) Applicant: TOYODA GOSEI CO., LTD., Kiyosu-shi, Aichi-ken (JP)

(72) Inventors: Kenichi Ito, Kiyosu (JP); Masaki Otake, Kiyosu (JP); Yasuyuki Mitsui, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 118 days.

(21) Appl. No.: 16/032,259

(22) Filed: Jul. 11, 2018

(65) Prior Publication Data

US 2019/0039441 A1 Feb. 7, 2019

(30) Foreign Application Priority Data

Aug. 2, 2017 (JP) ..... 2017-149932

(51) Int. Cl.
*B60H 1/34* (2006.01)
*F24F 13/15* (2006.01)
*F24F 13/14* (2006.01)

(52) U.S. Cl.
CPC ..... *B60H 1/3421* (2013.01); *F24F 13/142* (2013.01); *F24F 13/15* (2013.01); *B60H 2001/3464* (2013.01)

(58) Field of Classification Search
CPC ..... B60H 1/3421; B60H 2001/3464; F24F 13/142; F24F 13/15
USPC ..... 454/245, 284, 330
See application file for complete search history.

(56) References Cited

U.S. PATENT DOCUMENTS 7,229,348 B2 * 6/2007 Shibata ..... B60H 1/3421 454/155
9,321,328 B2 * 4/2016 Kong ..... B60H 1/3421

FOREIGN PATENT DOCUMENTS

JP 4643056 B2 3/2011

* cited by examiner

*Primary Examiner* — Jessica Yuen
(74) *Attorney, Agent, or Firm* — Posz Law Group, PLC

(57) ABSTRACT

A register for air-conditioning includes a plurality of fins in a retainer, each fin including: a plate-shaped fin main body; a fin shaft; and a coupling pin, the coupling pin rotatably inserted in a coupling hole of a coupling rod extending in an alignment direction of the fins, the coupling rod being in contact with the end face of each fin main body. The coupling rod includes a rod main body extending in the alignment direction. The coupling rod includes a circular disc portion which has a diameter larger than a width of the rod main body and which is provided around the coupling hole, and both side parts of the circular disc portion in a width direction of the rod main body protrude from the rod main body toward both sides in the width direction.

6 Claims, 5 Drawing Sheets

REGISTER FOR AIR-CONDITIONING

CROSS-REFERENCE TO RELATED APPLICATION(S)

This application is based upon and claims the benefit of priority from prior Japanese patent application No. 2017-149932, filed on Aug. 2, 2017, the entire contents of which are incorporated herein by reference.

BACKGROUND

The present invention relates to a register for air-conditioning configured to change a direction of air for air-conditioning, which is to be sent from an air conditioner and to be blown into a room, by fins.

For example, a register for air-conditioning configured to blow air for air-conditioning sent from an air conditioner is incorporated to an instrument panel of a vehicle. The register for air-conditioning includes a retainer having a flow path of the air for air-conditioning. The retainer has a plurality of fins aligned in a direction intersecting with a flow direction of the air for air-conditioning.

Each fin has a plate-shaped fin main body for changing the flow direction, a fin shaft protruding from the fin main body and configured to tiltably support the fin main body to the retainer, and a coupling pin protruding in parallel with the fin shaft from an end face of the fin main body. The coupling pin of each fin is rotatably inserted in a coupling hole of a coupling rod extending in an alignment direction of the fins. A link mechanism is configured by the coupling pin of each fin and the coupling rod (for example, refer to Japanese Patent No. 4,643,056B).

Accordingly, when a predetermined fin is tilted, the tilting is transmitted to all of the other fins by the link mechanism and the other fins are tilted in synchronization with the predetermined fin so that the other fins are to be inclined in the same tendency as the predetermined fin. As a result, the flow direction of the air for air-conditioning can be changed.

As the register for air-conditioning of the above type, there is a register for air-conditioning in which a plurality of fins is formed with coupling pins thereof being inserted in the coupling holes of the coupling rod by a two-color molding method. In the register for air-conditioning, the fins and the coupling rod are formed in a state where one surface of the coupling rod in a thickness direction is in contact with the end face of each fin main body.

When the fin main body and the coupling rod are contacted each other, as described above, friction is generated therebetween. A magnitude of the friction is different, depending on a contact area between the fin main body and the coupling rod.

In the register for air-conditioning of the related art, the contact area is changed in association with the tilting of the fin, so that a sliding resistance generated between the fin main body and the coupling rod is changed. As a result, an operation load that is generated when the operation for tilting the fin is performed is different depending on the inclination of the fin, which deteriorates an operation feeling.

SUMMARY

The above problem may be commonly caused in a configuration where the plurality of fins is coupled by the coupling rod with a main body of the coupling rod being in contact with the end face of the fin.

The present invention has been made in view of the above situations, and an object thereof is to provide a register for air-conditioning capable of improving an operation feeling when tilting a fin.

According to an aspect of the invention, there is provided a register for air-conditioning comprising a plurality of fins aligned in a direction intersecting with a flow direction of air for air-conditioning, in a retainer having a flow path of the air for air-conditioning, each of the fins including: a plate-shaped fin main body for changing the flow direction; a fin shaft protruding from the fin main body and configured to tiltably support the fin main body to the retainer; and a coupling pin protruding in parallel with the fin shaft from an end face of the fin main body, the coupling pin rotatably inserted in a coupling hole of a coupling rod extending in an alignment direction of the fins, the coupling rod being in contact with the end face of each fin main body, wherein the coupling rod includes a rod main body extending in the alignment direction, and the coupling rod includes a circular disc portion which has a diameter larger than a width of the rod main body and which is provided around the coupling hole, and both side parts of the circular disc portion in a width direction of the rod main body protrude from the rod main body toward both sides in the width direction.

DETAILED DESCRIPTION OF EXEMPLARY EMBODIMENTS

Hereinafter, an illustrative embodiment of a register for air-conditioning that is to be used with being incorporated to a vehicle will be described with reference to the drawings.

Meanwhile, in below descriptions, a traveling direction (advancing direction) of the vehicle is denoted as a front, a reverse direction of the vehicle is referred to as a rear, and a height direction is referred to as a vertical direction. Also, a vehicle width direction (right and left direction) is defined on the basis of when the vehicle is seen from the rear.

In a vehicle interior, an instrument panel (not shown) is provided in front of front seats (a driver seat and a passenger seat) of the vehicle, and registers for air-conditioning are incorporated in a central part, side parts and the like in the right and left direction. A main function of the register for air-conditioning is to change a direction (direction of the wind) of air for air-conditioning (warm air and cold air) that is to be sent from an air conditioner and to be blown into the vehicle interior.

Figure 1:
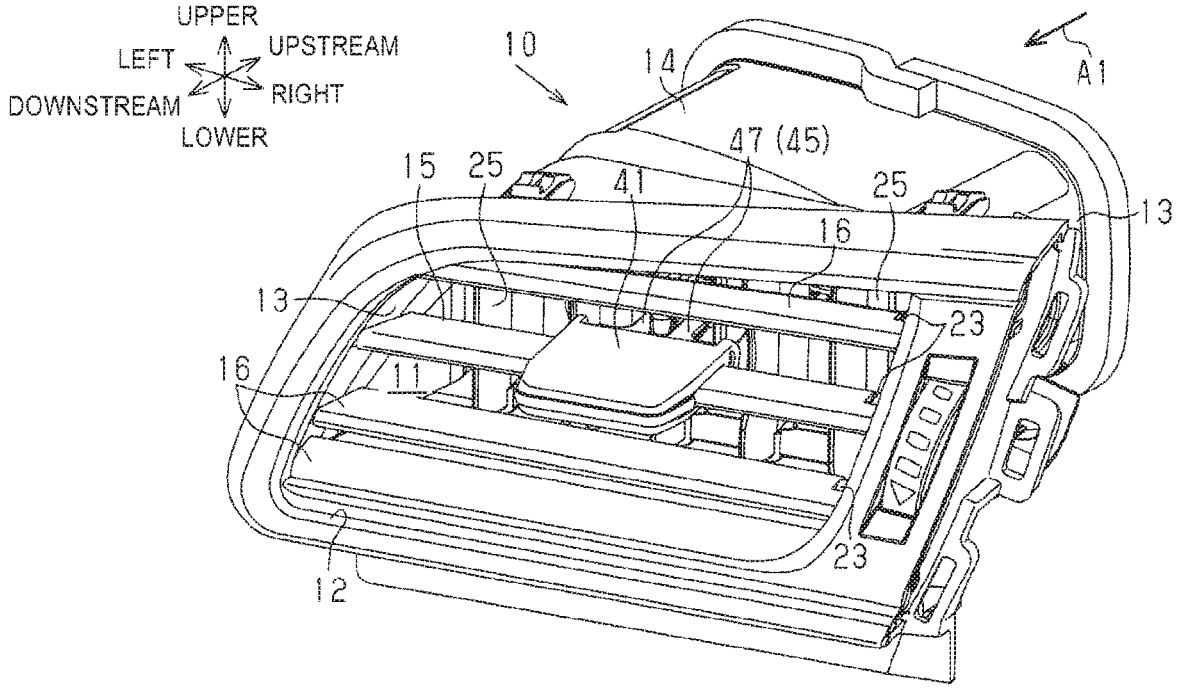
FIG. 1 is a perspective view depicting an entire register for air-conditioning of an illustrative embodiment.
Figure 2:
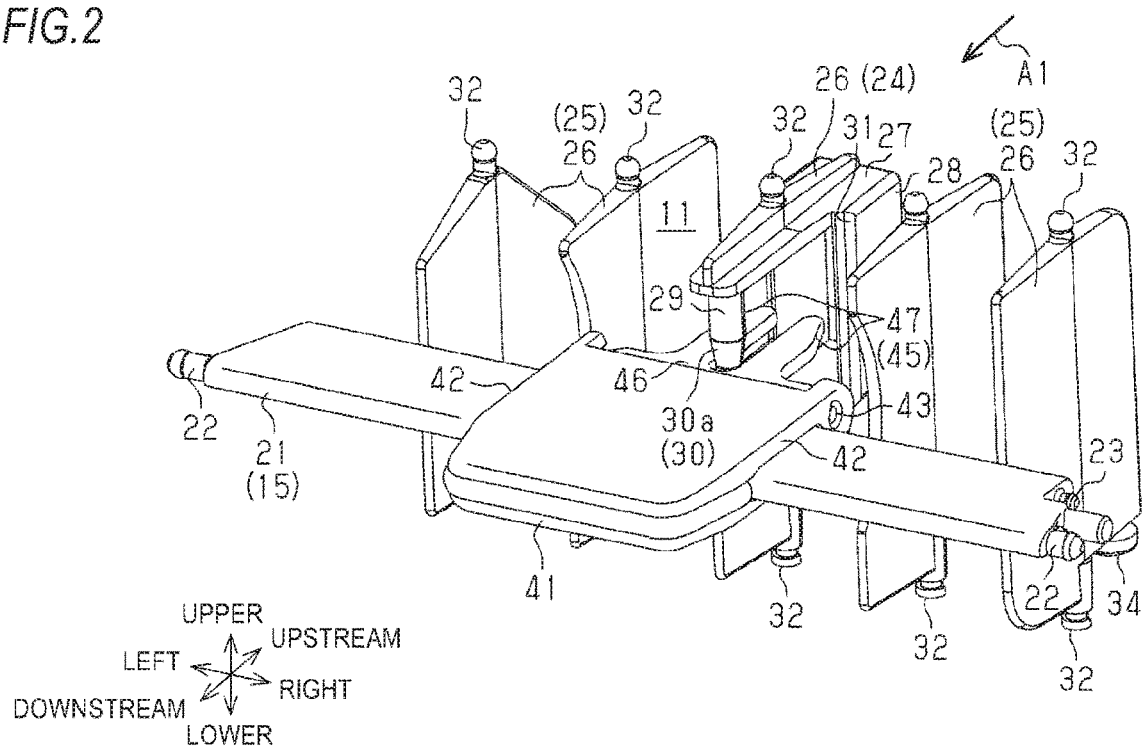
FIG. 2 is a perspective view in which upstream fins, a downstream fin, a knob and a fork are taken out from the register for air-conditioning of FIG. 1.

As shown in FIGS. 1 and 2, the register for air-conditioning includes a retainer 10, a plurality of fins, a knob 41 and a fork 45, as basic constitutional elements. In the below, configurations of the respective parts are described.

<Retainer 10>

The retainer 10 is to couple a blowing duct (not shown) of the air conditioner and an opening (not shown) provided to the instrument panel each other. The retainer 10 is configured by a plurality of members formed of a rigid resin material, and has a tube shape of which both ends are opened. An internal space of the retainer 10 configures a flow path (hereinafter, referred to as "ventilation passage 11") of an air A1 for air-conditioning to be sent from the air conditioner. Here, regarding a flow direction of the air A1 for air-conditioning, a side close to the air conditioner is referred to as "upstream", and a side distant from the air conditioner is referred to as "downstream". A downstream end of the ventilation passage 11 configures an ejection port 12 of the air A1 for air-conditioning.

The ventilation passage 11 is surrounded by four wall portions of the retainer 10. The four wall portions include a pair of vertical wall portions 13 facing each other in the right and left direction, and a pair of horizontal wall portions 14 facing each other in the vertical direction.

<Fin>

The fin has a plurality of downstream fins and a plurality of upstream fins.

The plurality of downstream fins is aligned with being spaced from each other in the vertical direction, in the vicinity of the upstream of the ejection port 12 of the ventilation passage 11. This direction is a direction intersecting with the flow direction.

Here, in order to distinguish the plurality of downstream fins, a fin located in the vicinity of a central part in the vertical direction is referred to as "downstream fin 15", and the other fins are referred to as "downstream fins 16".

Each of the downstream fins 15, 16 has a plate-shaped downstream fin main body 21, a pair of downstream fin shafts 22, and a downstream coupling pin 23. Each downstream fin main body 21 has an elongated plate shape in the right and left direction than in the flow direction of the air A1 for air-conditioning. The pair of downstream fin shafts 22 provided to each of the downstream fins 15, 16 protrudes from both end faces of the downstream fin main body 21 in the right and left direction toward a direction of getting away from the downstream fin main body 21 in the right and left direction. Each of the downstream fins 15, 16 is supported at both the left and right downstream fin shafts 22 to both the left and right vertical wall portions 13, and can be tilted in the vertical direction at both the downstream fin shafts 22, which are support points. The downstream coupling pin 23 protrudes rightward in parallel with the downstream fin shaft 22 from a part, which is biased upstream from the downstream fin shaft 22, of a right end face of each downstream fin main body 21.

The downstream coupling pins 23 of the respective downstream fins 15, 16 are coupled to each other by a downstream coupling rod (not shown) extending substantially in the vertical direction. By the downstream coupling pins 23 of the respective downstream fins 15, 16 and the downstream coupling rod, a link mechanism (not shown) is configured which is configured to mechanically couple the plurality of downstream fins 15, 16 and to tilt the downstream fins 16 in synchronization with the downstream fin 15 so that the downstream fins 16 are to be inclined in the same tendency as the downstream fin 15.

The plurality of upstream fins is aligned with being spaced from each other in the right and left direction, in the vicinity of the more upstream side of the ventilation passage 11 than the downstream fin 15, 16. This direction is a direction intersecting with the flow direction and the alignment direction (vertical direction) of the downstream fins 15, 16.

Here, in order to distinguish the plurality of upstream fins, a fin located in the vicinity of a central part in the right and left direction is referred to as "upstream fin 24", and the other fins are referred to as "upstream fins 25".

Figure 3:
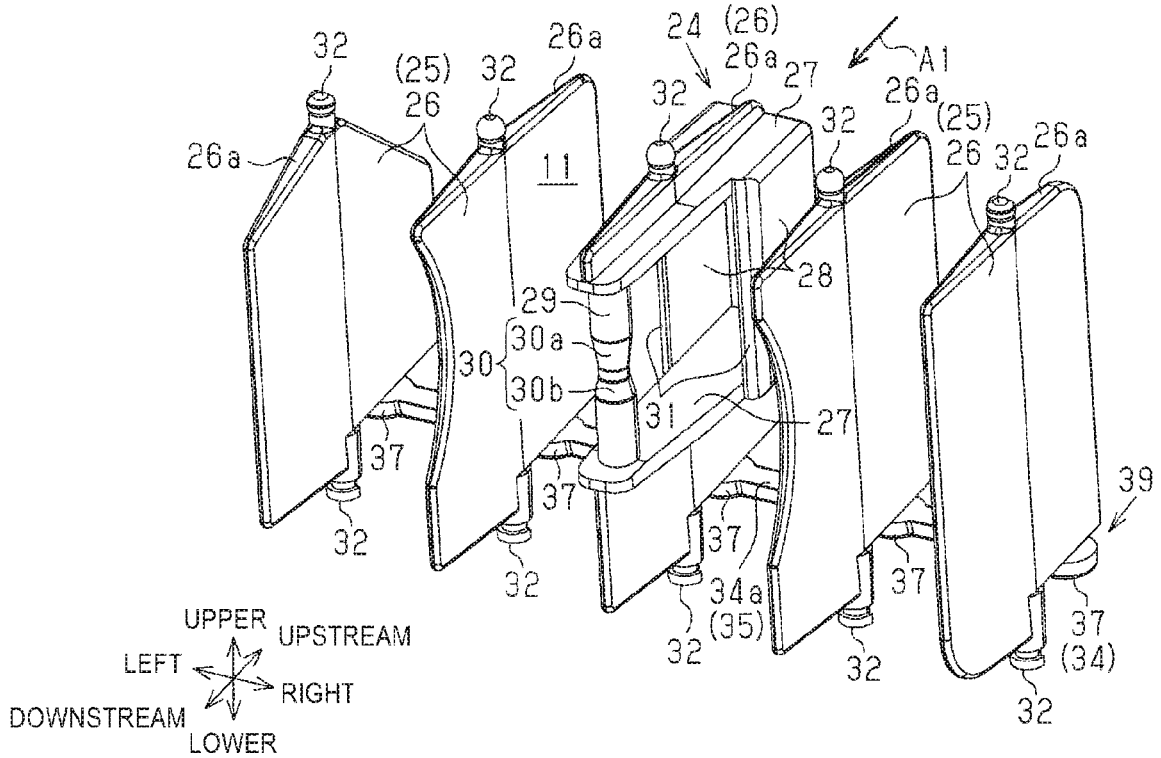
FIG. 3 is a perspective view, as obliquely seen from above, in which the upstream fins and an upstream coupling rod are taken out from the register for air-conditioning of FIG. 1.
Figure 4:
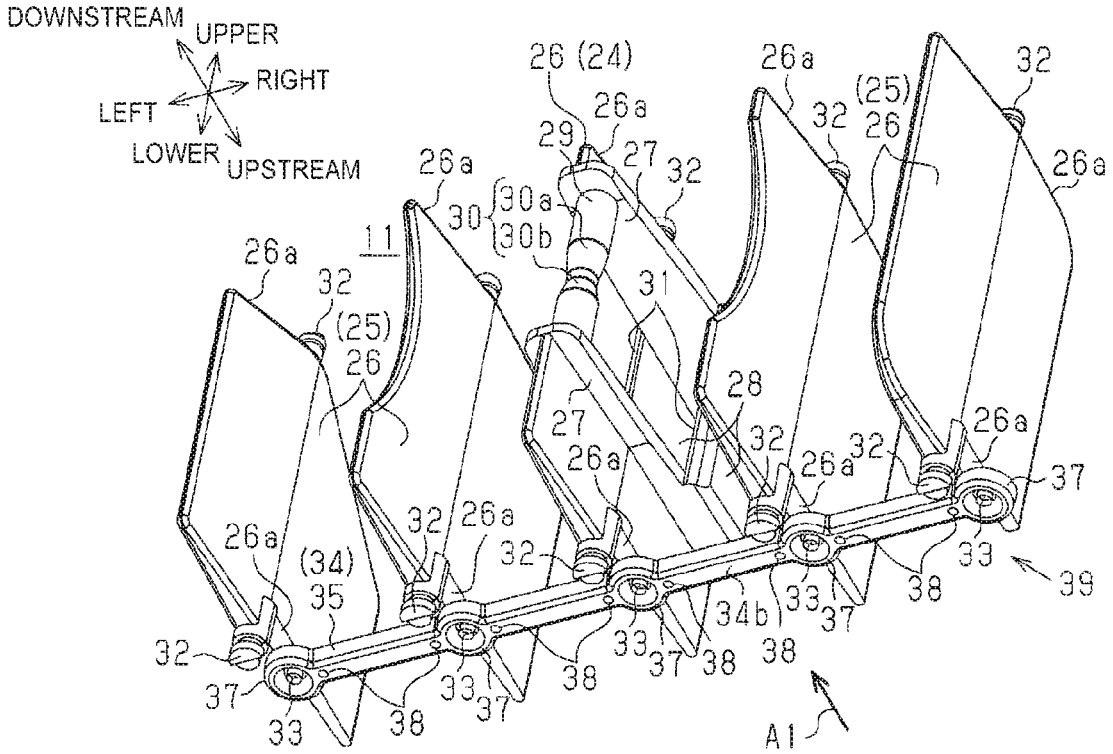
FIG. 4 is a perspective view of the upstream fins and the upstream coupling rod of FIG. 3, as obliquely seen from below.
Figure 5:
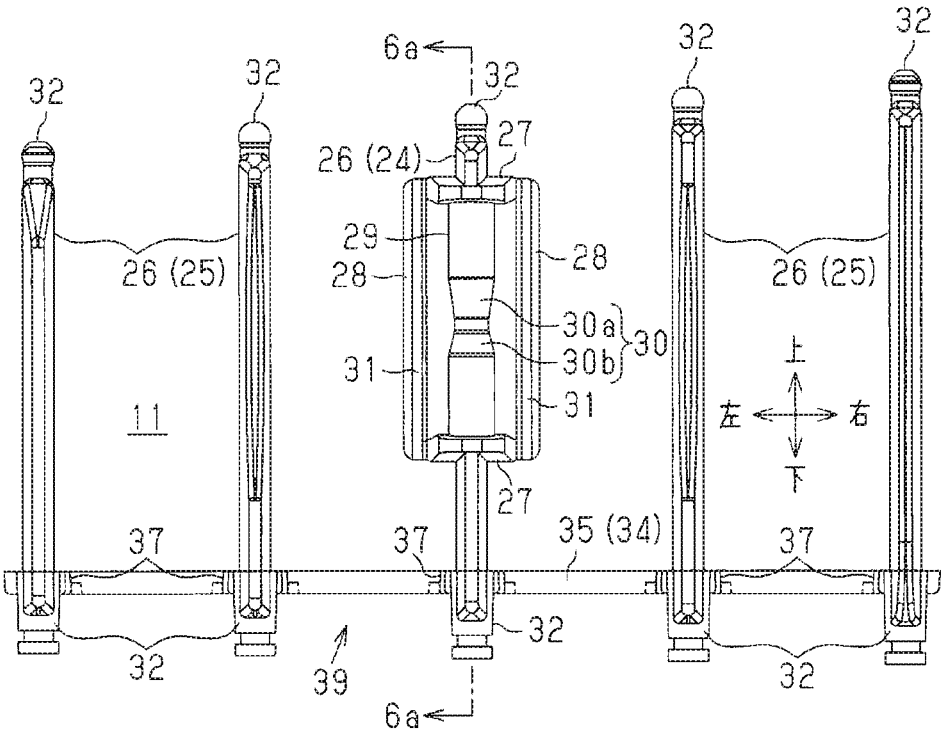
FIG. 5 is a front view of the upstream fins and the upstream coupling rod of FIGS. 3 and 4.

As shown in FIGS. 3 and 4, each of the upstream fins 24, 25 has a plate-shaped upstream fin main body 26, a pair of upper and lower upstream fin shafts 32, and an upstream coupling pin 33. The upstream fin main body 26 has a plate shape extending in the flow direction of the air A1 for air-conditioning and in the vertical direction. The pair of upstream fin shafts 32 provided to each of the upstream fins 24, 25 protrudes from parts, which are adjacent to central parts in the flow direction, of both upper and lower end faces 26*a* of the upstream fin main body 26 toward a direction of getting away from the upstream fin main body 26 in the vertical direction. Each of the upstream fins 24, 25 is supported at both the upper and lower upstream fin shafts 32 to both the upper and lower horizontal wall portions 14 (refer to FIG. 1), and can be tilted in the right and left direction at both the upstream fin shafts 32, which are support points. The upstream coupling pin 33 protrudes downward in parallel with the upstream fin shaft 32 from a part, which is biased upstream from the upstream fin shaft 32, of the lower end face 26*a* of the upstream fin main body 26, more correctly, from an intermediate part between the upstream fin shaft 32 and an upstream end of the upstream fin main body 26 (refer to FIGS. 6A and 6B).

Figure 8:
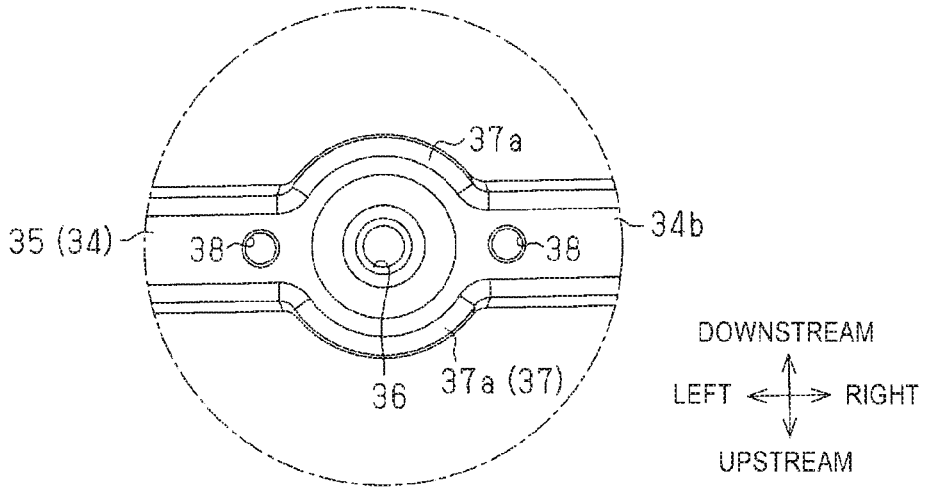
FIG. 8 is a partial bottom view of the upstream coupling rod of the illustrative embodiment.

The upstream coupling pins 33 of the respective upstream fins 24, 25 are coupled each other by an upstream coupling rod 34. More specifically, a main part of the upstream coupling rod 34 is configured by a rod main body 35 extending in the right and left direction. As shown in FIGS. 6B and 8, the rod main body 35 is formed with a plurality of coupling holes 36 formed to penetrate the rod main body 35 in the vertical direction and substantially equidistantly spaced in the right and left direction. The coupling holes 36 of both ends in the right and left direction are located at both end parts of the rod main body 35 in the right and left direction. An inner wall surface 36*a* of each coupling hole 36 has a tapered shape of which a diameter increases downward.

Figures 7A, 7B:
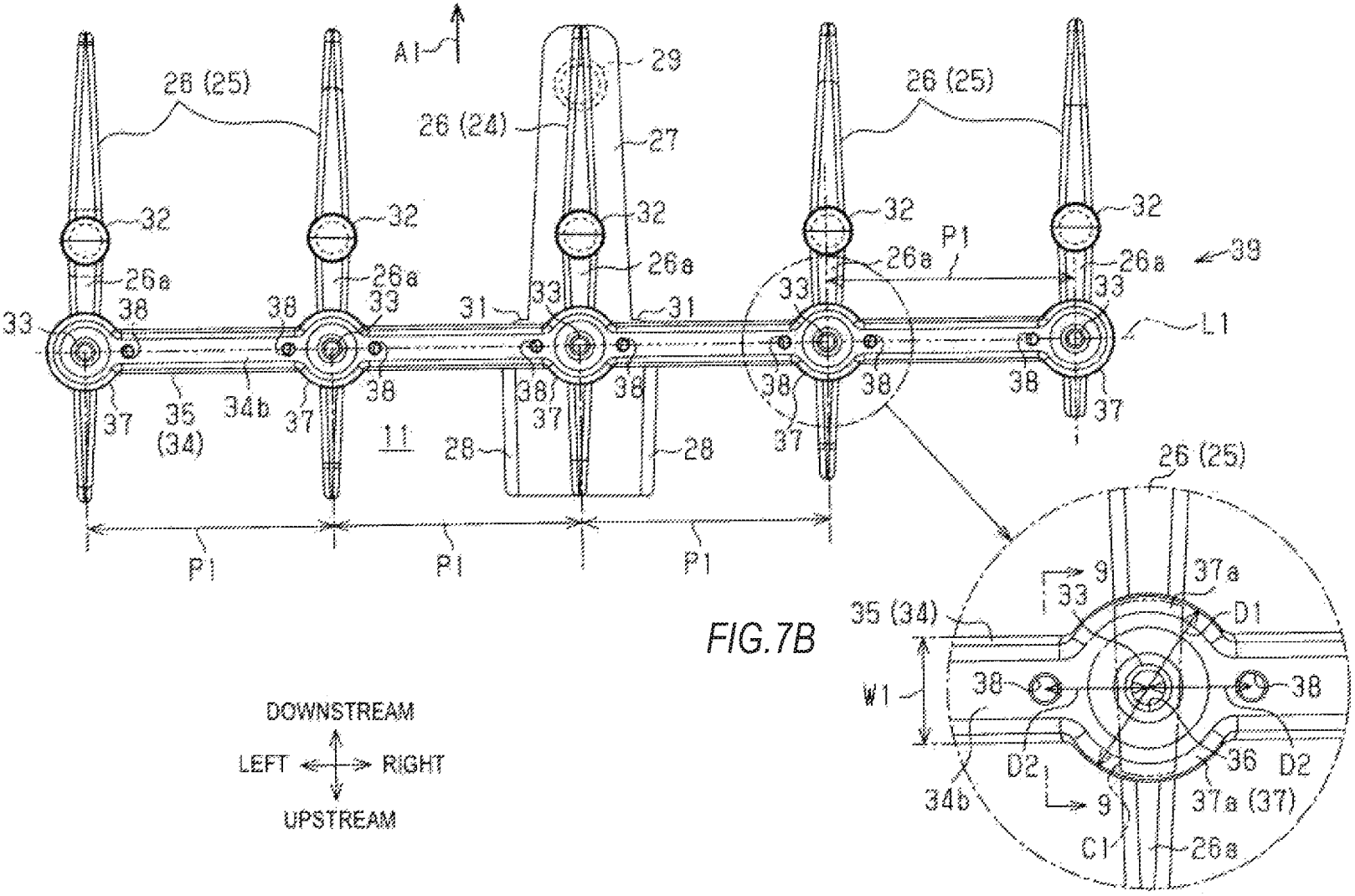
FIG. 7A is a bottom view of the upstream fins and the upstream coupling rod of FIGS. 3 and 4.
FIG. 7B is a partially enlarged bottom view of a part of FIG. 7A.

As shown in FIGS. 7A and 7B, when a dimension of the rod main body 35 in the flow direction is referred to as "width W", the upstream coupling rod 34 has a circular disc portion 37 having a diameter D1 greater than the width W1, around the coupling hole 36. Both side parts 37*a* of each circular disc portion 37 in the width direction of the rod main body 35 protrude along both sides from the rod main body 35 in the width direction.

The upstream fins 24, 25 and the upstream coupling rod 34 are formed of resin materials of different types (for example, PP and ABS).

As shown in FIG. 6B, the upstream coupling pin 33 of each of the upstream fins 24, 25 is rotatably inserted in the corresponding coupling hole 36. A boundary part of the upstream coupling pin 33 with the upstream fin main body 26 is formed with a tapered part 33*a* of which a diameter increases downward. Each upstream coupling pin 33 is inserted in the coupling hole 36 at the tapered part 33*a*. A part, which is lower than the tapered part 33*a*, of the upstream coupling pin 33 is exposed to the below of the coupling hole 36. The insertion of the upstream coupling pin 33 into the coupling hole 36 is made in a state where an upper surface 34*a* of the upstream coupling rod 34 is in contact with the lower end face 26*a* of each upstream fin main body 26. Here, the end face 26*a* with which the upper surface 34*a* of the upstream coupling rod 34 is in contact is the end face 26*a* of a part, from which the upstream coupling pin 33 protrudes, of the lower end face 26*a* of the upstream fin main body 26. Each coupling hole 36 is engaged to the tapered part 33*a* of each upstream coupling pin 33 at the inner wall surface 36*a*, so that the upstream coupling rod 34 is restrained from falling down from the upstream coupling pin 33.

Figure 9:
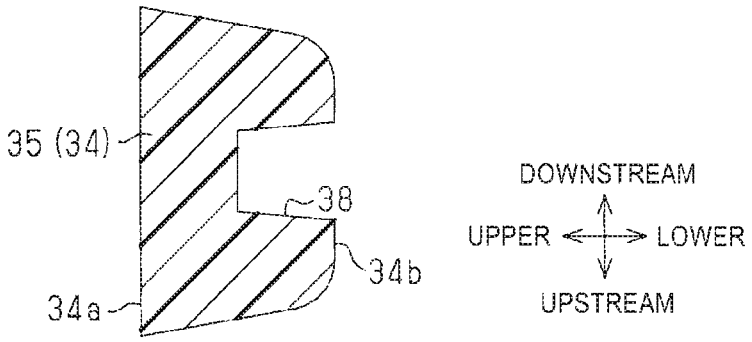
FIG. 9 is a sectional view taken along a line 9-9 of FIG. 7B.

As shown in FIGS. 7A and 7B, the rod main body 35 is formed with void portions 38 between the adjacent circular disc portions 37. The void portions 38 corresponding to the circular disc portion 37 of an intermediate part in the right and left direction are formed at places at which the corresponding circular disc portion 37 is sandwiched from both sides in the right and left direction. In contrast, the void portions 38 corresponding to the circular disc portions 37 of both end parts in the right and left direction are respectively formed at places, which are adjacent to the next circular disc portions 37, of the circular disc portions 37 of both end parts. All of the void portions 38 are located on a virtual line L1 passing a central part of the rod main body 35 in the width direction and extending in the right and left direction and at places adjacent to the circular disc portions 37. Particularly, the pair of void portions 38 that sandwiches the circular disc portion 37 of the intermediate part in the right and left direction is located at places that are distant from an axis line of the coupling hole 36 corresponding to the void portions 38 by an equal distance D2. As shown in FIG. 9, each void portion 38 is configured by a concave part, which opens to a lower surface 34*b* of the upstream coupling rod 34 and has a diameter increasing toward the lower.

As shown in FIG. 4, by the upstream coupling pin 33 provided to each of the upstream fins 24, 25 and the upstream coupling rod 34, a link mechanism 39 is configured which is configured to mechanically couple the plurality of upstream fins 24, 25 and to tilt the upstream fins 25 in synchronization with the upstream fin 24 so that the upstream fins 25 are to be inclined in the same tendency as the upstream fin 24.

As shown in FIGS. 3, 5, 6A and 6B, the upstream fin 24 has a configuration, which is provided at an intermediate part of the upstream fin main body 26 in the vertical direction and is different from the other upstream fins 25. In this configuration, a part of the upstream fin main body 26 of the upstream fin 24 is replaced to a pair of horizontal plate portions 27, a pair of vertical plate portions 28 and a transmission shaft portion 29. The pair of horizontal plate portions 27 intersects perpendicularly or substantially perpendicularly to axis lines of the upper and lower upstream fin shafts 32 at places located between both the upper and lower upstream fin shafts 32 and spaced from each other in the vertical direction. Both the horizontal plate portions 27 have a flat plate shape of which a dimension in a thickness direction (the right and left direction) of the upstream fin main body 26 is smaller than a dimension in the flow direction of the air A1 for air-conditioning. The pair of vertical plate portions 28 extends in the vertical direction at upstream parts of both the upper and lower horizontal plate portions 27, in parallel or substantially parallel with each other. The left vertical plate portion 28 is configured to couple left edge parts of both the horizontal plate portions 27, and the right vertical plate portion 28 is configured to couple right edge parts of both the horizontal plate portions 27. The transmission shaft portion 29 extends in the vertical direction, and is configured to couple downstream end parts of both the horizontal plate portions 27 (refer to FIG. 4). An intermediate part of the transmission shaft portion 29 in the vertical direction is provided with an engagement portion 30. The engagement portion 30 has a tapered surface 30*a* of which a diameter increases toward an upper side, and a tapered surface 30*b* that is formed in the vicinity of a lower side of the tapered surface 30*a* and has a diameter increasing a lower side.

Since void parts between both the upper and lower horizontal plate portions 27 and between both the vertical plate portions 28 and the transmission shaft part 29 have a shape formed by notching a downstream part of each vertical plate portion 28, the void parts are respectively referred to as a notched part 31, in the below.

<Knob 41 and Fork 45>

As shown in FIGS. 1 and 2, the knob 41 is a member that is to be operated by a passenger when changing an ejection direction of the air A1 for air-conditioning from the ejection port 12, and is mounted to the downstream fin 15 to be slidable in the right and left direction. Left and right sidewall portions 42 of the knob 41 are provided upstream of the downstream fin 15 with bearing holes 43.

The fork 45 is a member for transmitting a slide operation of the knob 41 to the upstream fin 24. A downstream part of the fork 45 is configured by a long plate-shaped main body portion 46 extending in the right and left direction. Both left and right end parts of the main body portion 46 are formed with fork shafts (not shown). Each of the fork shafts is rotatably inserted in the corresponding bearing hole 43 of the knob 41. The fork 45 has a pair of transmission pieces 47 extending in parallel with each other upstream from parts, which are spaced from each other in the right and left direction, of the main body portion 46. Both the transmission pieces 47 are configured to sandwich the engagement portion 30 of the transmission shaft portion 29 from both left and right sides.

Subsequently, operations and effects of the illustrative embodiment configured as described above are described.

<Regarding Formations of Upstream Fins 24, 25 and Upstream Coupling Rod 34>

As shown in FIGS. 3 and 4, the plurality of upstream fins 24, 25 and the upstream coupling rod 34 where the upstream coupling pins 33 are respectively inserted in the coupling holes 36 are formed by a two-color molding method. The two-color molding method is one aspect of a molding method of a resin material, and is to integrally combine and mold different materials. In the two-color molding method, multiple types of metallic molds are prepared, a basic metallic mold is rotated and resin injection processing is performed in multiple stages, so that two types of resins are injected during one molding. A primary-side part (the upstream coupling rod 34) is molded, and a secondary-side part (the upstream fins 24, 25) is then molded integrally with the primary-side part in the same metallic mold. By the two-color molding method, the upstream fins 24, 25 and the upstream coupling rod 34 where the upper surface 34*a* of the upstream coupling rod 34 is coupled with being in contact with the lower end face 26*a*, from which the upstream coupling pin 33 protrudes, of each upstream fin main body 26 are molded. For this reason, it is not necessary to perform processes of forming individually the plurality of upstream fins 24, 25 and the upstream coupling rod 34, inserting the upstream coupling pin 33 of each of the upstream fins 24, 25 into the coupling hole 36 and coupling the upstream fins to the upstream coupling rod 34, so that it is possible to save the manufacturing cost.

Here, the upstream coupling rod 34 has an elongated shape in the right and left direction. For this reason, a melted resin formed to have the shape of the upstream coupling rod 34 is more shrunken in a longitudinal direction (the right and left direction) of the upstream coupling rod 34 than in the other directions when it is cooled and cured. When the shrinkage amount is different between the adjacent coupling holes 36 and an interval P (refer to FIG. 7A) between the coupling holes 36 is not uniform, the axis line of the upstream coupling pin 33 is not parallel between the plurality of upstream fins 24, 25 and a sliding resistance between the upstream fin main body 26 and the upstream coupling rod 34 is not uniform. When tilting the upstream fins 24, 25, an operation load is not uniform, so that an operation feeling is deteriorated.

In the illustrative embodiment, the rod main body 35 is formed with the void portions 38 between the adjacent circular disc portions 37. The void portions 38 absorb the shrinkage in the longitudinal direction (the right and left direction) of the rod main body 35 when the melted resin is cooled and cured. By the absorption, the non-uniformity of the shrinkage amount of the melted resin between the adjacent coupling holes 36 is suppressed and the non-uniformity of the interval P1 between the adjacent coupling holes 36 is reduced.

Particularly, in the illustrative embodiment where the respective void portions 38 are formed at places adjacent to the circular disc portions 37, the operation of the void portions 38 suppressing the shrinkage of the melted resin is made at the places of the rod main body 35 adjacent to the circular disc portions 37. For this reason, the non-uniformity of the interval P1 between the coupling holes 36 is reduced.

Also, the respective void portions 38 are formed at places adjacent to the circular disc portions 37, so that an influence of the shrinkage on the shape of the circular disc portions 37 is reduced and each circular disc portion 37 is formed to have a shape closer to a circular shape. Also, the operation of the respective void portions 38 suppressing the shrinkage of the melted resin is made on the virtual line L1 set for the rod main body 35. For this reason, the non-uniformity of the interval P1 between the coupling holes 36 is reduced.

The operation of the pair of void portions 38, which are provided to sandwich the circular disc portion 37 provided at the intermediate part in the right and left direction, suppressing the shrinkage of the melted resin is made at places distant from the coupling holes 36 by the equal distance D2. For this reason, the non-uniformity of the interval P1 is further reduced.

<Upon Operation of Knob 41>

Figure 10:
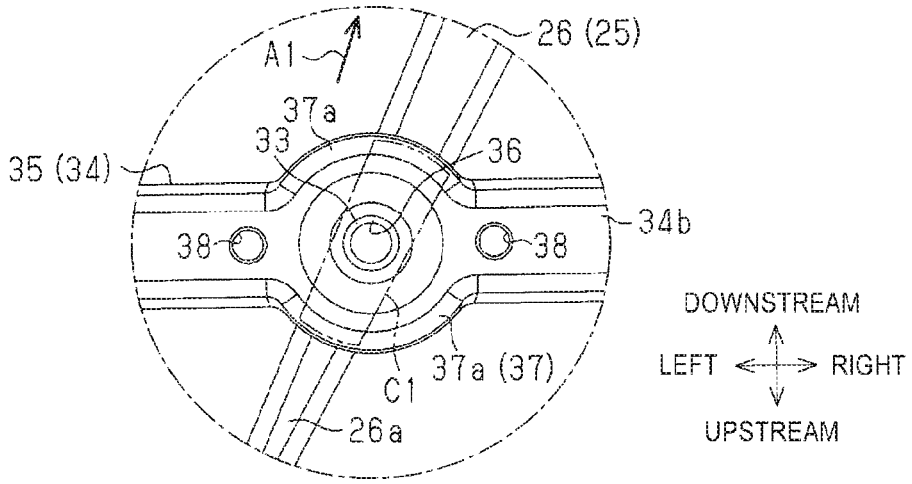
FIG. 10 is a partial bottom view of the upstream fins and the upstream coupling rod when the upstream fin is tilted from a state of FIG. 7B.

When changing the ejection direction of the air A1 for air-conditioning in the right and left direction, the knob 41 shown in FIGS. 1 and 2 is slide-operated in the right and left direction along the downstream fin 15. Accompanied by the operation, the movement of the knob 41 is transmitted to the upstream fin 24 through the fork 45 and the transmission shaft portion 29. The transmission shaft portion 29 is pressed by the transmission piece 47 provided at the rear side of the knob 41 in the slide direction. The upstream fin 24 is tilted in the same direction as the slide operation of the knob 41 at both the upper and lower upstream fin shafts 32, which are support points. As shown in FIGS. 3 and 4, accompanied by the tilting, the upstream coupling pin 33 of the upstream fin 24 is rotated around the upstream fin shafts 32. This rotation is transmitted to the upstream coupling pins 33 of the other upstream fins 25 via the upstream coupling rod 34, so that the respective upstream coupling pins 33 are rotated around the upstream fin shafts 32. In this way, the tilting of the upstream fin 24 is transmitted to all the other upstream fins 25 via the link mechanism 39. As a result, all the other upstream fins 25 are tilted in the same direction as the upstream fin 24, in conjunction with the upstream fin 24 (refer to FIG. 10). The air A1 for air-conditioning flows along each of the tilted upstream fins 24, 25 and can thus change the flow direction while it passes the ventilation passage 11.

At this time, an angle of the upstream fin 24 relative to the transmission pieces 47 of the fork 45 changes. Since this change is made at the notched portions 31, an interference between the vertical plate portions 28 and the transmission pieces 47 is suppressed.

Figure 6A:
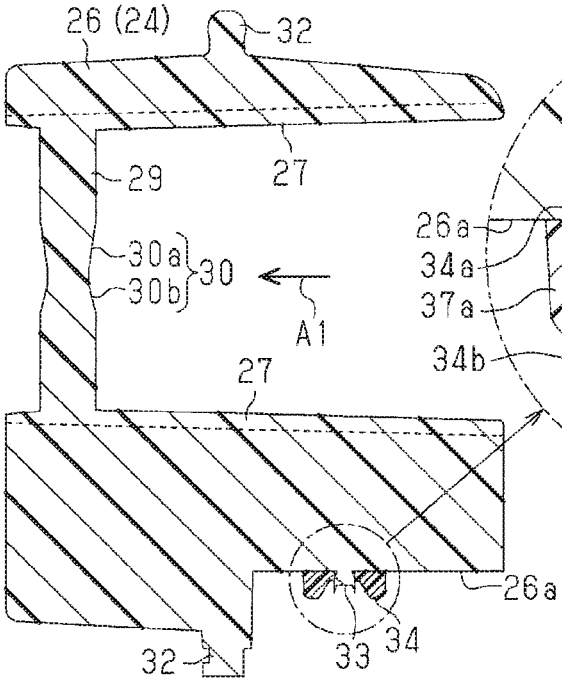
FIG. 6A is a sectional view taken along a line 6*a*-6*a* of FIG. 5.
Figure 6B:
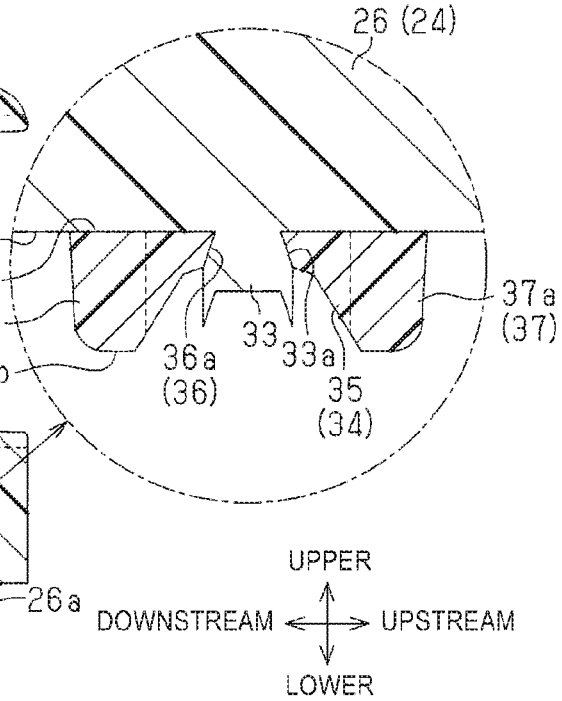
FIG. 6B is a partially enlarged sectional view of a part of FIG. 6A.

Here, according to the register for air-conditioning of the illustrative embodiment, as shown in FIGS. 6A and 6B, since the upper surface 34*a* of the upstream coupling rod 34 is in contact with the lower end face 26*a*, from which the upstream coupling pin 33 protrudes, of each upstream fin main body 26, friction is generated between the upstream fin main body 26 and the upstream coupling rod 34 when each of the upstream fins 24, 25 is tilted. A magnitude of the friction is small when a contact area between the upstream fin main body 26 and the upstream coupling rod 34 is small, but increases as the contact area increases.

Regarding this, according to the illustrative embodiment, as shown in FIGS. 7A and 7B, the upstream coupling rod 34 has the circular disc portions 37 around the coupling holes 36. Each circular disc portion 37 has the diameter D1 larger than the width W1 of the rod main body 35.

Furthermore, both the side parts 37*a* of the circular disc portion 37 in the width direction of the rod main body 35 protrude from the rod main body 35 toward both sides in the width direction. For this reason, as shown with the dashed-two dotted line in FIGS. 7B and 10, a magnitude of a contact surface C 1 (the contact area) between the upstream fin main body 26 and the upstream coupling rod 34 is substantially constant, irrespective of the angle of the upstream fin main body 26 relative to the rod main body 35. That is, when the upstream fins 24, 25 are tilted, the contact area is difficult to change, so that the sliding resistance to be generated between the upstream fin main body 26 and the upstream coupling rod 34 is substantially constant. As a result, a situation where the operation load upon the tilting operation of the upstream fins 24, 25 largely changes depending on the inclination of the upstream fins 24, 25 hardly occurs.

Also, as described above, when molding the upstream coupling rod 34, the void portions 38 are also formed, so that the non-uniformity of the interval P1 between the adjacent coupling holes 36 is reduced. For this reason, also in this regard, the non-uniformity of the sliding resistance between the upstream fin main body 26 and the upstream coupling rod 34 is suppressed, and when tilting the upstream fins 24, 25, the operation feeling is improved, as compared to a configuration where the void portions 38 are not provided.

Particularly, in the illustrative embodiment, as described above, the shrinkage suppression of the melted resin by the void portions 38 is made at places of the rod main body 35, which are adjacent to the circular disc portions 37, so that the non-uniformity of the interval P1 between the coupling hole 36 is reduced. For this reason, the non-uniformity of the sliding resistance between the upstream fin main body 26 and the upstream coupling rod 34 is suppressed, and when tilting the upstream fins 24, 25, the operation feeling is improved, as compared to a configuration where the void portions 38 are formed at places distant from the circular disc portions 37.

Also, as described above, the void portions 38 are formed at places adjacent to the circular disc portions 37, so that the circular disc portions 37 are formed to have a shape closer to a circular shape. Accordingly, the contact area between the upstream fin main body 26 and the upstream coupling rod becomes constant, irrespective of the angle of the upstream fin main body 26 relative to the rod main body 35. That is, when the upstream fins 24, 25 are tilted, the contact area is more difficult to change, so that the sliding resistance to be generated between the upstream fin main body 26 and the upstream coupling rod 34 becomes more constant. As a result, a situation where the operation load upon the tilting operation of the upstream fins 24, 25 changes depending on the inclination of the upstream fins 24, 25 is more difficult to occur.

Also, as described above, since the shrinkage suppression of the melted resin by the void portions 38 is made on the virtual line L1 and the non-uniformity of the interval P1 between the coupling hole 36 is reduced, the non-uniformity of the sliding resistance between the upstream fin main body 26 and the upstream coupling rod 34 is effectively suppressed. When tilting the upstream fins 24, 25, the operation load becomes more stable, as compared to a configuration where the positions of the void portions 38 in the width direction of the rod main body 35 are not uniform between the adjacent coupling holes 36.

Also, as described above, since the shrinkage suppression of the melted resin by both the void portions 38 is made at places distant from the coupling holes 36 by the equal distance D2, the non-uniformity of the interval P1 between the coupling holes 36 is reduced. The non-uniformity upstream of the sliding resistance between the fin main body 26 and the upstream coupling rod 34 is suppressed. As compared to a configuration where the distances D2 of the pair of void portions 38 configured to sandwich the circular disc portion 37 from the coupling holes 36 are different, the operation load becomes more stable when tilting the upstream fins 24, 25.

In the meantime, when changing the vertical ejection direction of the air A1 for air-conditioning, a force is applied to the knob 41 in the thickness direction (vertical direction), in FIGS. 1 and 2. This force is transmitted to the downstream fin 15 to which the knob 41 is mounted. The downstream fin 15 is tilted at both the left and right downstream fin shafts 22, which are support points. The tilting of the downstream fin 15 is transmitted to all the other downstream fins 16 via the link mechanism. As a result, all the other downstream fins 16 are tilted in the same direction as the operated knob 41 at both the left and right downstream fin shafts 22, which are support points, in conjunction with the downstream fin 15 operated through the knob 41. The air A1 for air-conditioning having passed the respective upstream fins 24, 25 flows along the tilted downstream fins 15, 16 and can thus change flow direction.

At this time, the fork 45 is rotated at the fork shaft relative to the knob 41, and both the transmission pieces 47 are slid relative to the engagement portion 30, so that the force is not transmitted to the transmission shaft portion 29 and the upstream fin 24 is not tilted.

The air A1 for air-conditioning flows in the inclined directions of the upstream fins 24, 25 and the downstream fins 15, 16 and is ejected from the ejection port 12. In this way, at least one of the upstream fins 24, 25 and the downstream fins 15, 16 is tilted as a result of the operation of the knob 41, so that the direction of the air A1 for air-conditioning to be ejected from the ejection port 12 is changed.

In the meantime, the illustrative embodiment can be modified as follows.

<Regarding Link Mechanism 39>

The upstream coupling pin 33 may be provided on the upper end face 26*a*, other than the lower end face 26*a* of the upstream fin main body 26 provided to each of the upstream fins 24, 25, and may be coupled by an upstream coupling rod arranged at a position higher than the upstream fins 24, 25.

The configuration of the upstream-side link mechanism 39 configured to couple the upstream coupling pins 33 of the upstream fins 24, 25 by the upstream coupling rod 34 having the circular disc portions 37 and the void portions 38 can also be applied to the downstream-side link mechanism configured to couple the downstream coupling pins 23 of the downstream fins 15, 16 by the downstream coupling rod.

Each void portion 38 may be configured by a hole formed to penetrate the rod main body 35.

The pair of void portions 38 configured to sandwich the circular disc portion 37 may not be necessarily formed at places distant from the axis line of the coupling hole 36 by the equal distance D2, and may be formed at places distant from the axis line of the coupling hole 36 by different distances.

The sectional shape of the void portion 38 may be changed to a non-circular shape.

The void portion 38 may be formed at a place more distant than the place adjacent to the circular disc portion 37, on condition that it is formed outside the circular disc portion 37.

The coupling hole 36 and the circular disc portion 37 may be formed so that the axis lines thereof are located at places deviating from the central part of the rod main body 35 in the width direction. In this case, a protrusion amount of the circular disc portion 37 from the rod main body 35 in the width direction is different between the pair of side parts 37*a*.

At least one of the plurality of void portions 38 may be formed at a place deviating from the virtual line L1 in the width direction of the rod main body 35. The distance D2 of the void portion 38 from the axis line of the coupling hole 36 may be different between the pair of void portions 38 configured to sandwich the circular disc portion 37.

As the upstream coupling rod 34, a rod of which the rod main body 35 is curved, other than linear, may be used.

<Regarding Fin>

Contrary to the illustrative embodiment, a plate-shaped fin extending in the right and left direction may be used as each of the upstream fins 24, 25, and a plate-shaped fin extending in vertical direction may be used as each of the downstream fins 15, 16.

<Regarding Applying Places>

The register for air-conditioning can also be applied to a case where the upstream fins 24, 25 and the upstream coupling rods 34 are formed by a molding method other than the two-color molding method, on condition that the upper surface 34*a* of the upstream coupling rod 34 is in contact with the lower end face 26*a*, from which the upstream coupling pin 33 protrudes, of each upstream fin main body 26.

The register for air-conditioning can also be applied to a register for air-conditioning that is to be incorporated to a place different from the instrument panel in the vehicle interior.

The register for air-conditioning is not limited to the vehicle and can be widely applied inasmuch as it can change the direction of the air for air-conditioning to be sent from the air conditioner and to be ejected into a room from the ejection port.

According to an aspect of the invention, there is provided a register for air-conditioning comprising a plurality of fins aligned in a direction intersecting with a flow direction of air for air-conditioning, in a retainer having a flow path of the air for air-conditioning, each of the fins including: a plate-shaped fin main body for changing the flow direction; a fin shaft protruding from the fin main body and configured to tiltably support the fin main body to the retainer; and a coupling pin protruding in parallel with the fin shaft from an end face of the fin main body, the coupling pin rotatably inserted in a coupling hole of a coupling rod extending in an alignment direction of the fins, the coupling rod being in contact with the end face of each fin main body, wherein the coupling rod includes a rod main body extending in the alignment direction, and the coupling rod includes a circular disc portion which has a diameter larger than a width of the rod main body and which is provided around the coupling hole, and both side parts of the circular disc portion in a width direction of the rod main body protrude from the rod main body toward both sides in the width direction.

In the register for air-conditioning configured as described above, since the coupling rod is in contact with the end face of each fin main body, when each fin is tilted, friction is generated between the fin main body and the coupling rod. A magnitude of the friction is different depending on a contact area between the fin main body and the coupling rod.

According to the above configuration, the coupling rod has the circular disc portion around the coupling hole. Each circular disc portion has a diameter larger than a width of the rod main body. Further, both side parts of the circular disc portion in the width direction of the rod main body protrude from the rod main body toward both sides in the width direction. For this reason, the contact area between the fin main body and the coupling rod is substantially constant, irrespective of an angle of the fin main body relative to the rod main body. That is, when the fin is tilted, the contact area is difficult to change, so that the sliding resistance generated between the fin main body and the coupling rod is substantially constant. As a result, a situation where an operation load that is to be generated when tilting the fin largely changes depending on the inclination of the fin hardly occurs.

All the fins and the coupling rod may be formed by different types of resin materials in a state where one surface of the coupling rod in a thickness direction is in contact with the end face of each fin main body, and a void portion may be formed between adjacent two of the circular disc portion of the rod main body.

In the register for air-conditioning configured as described above, all the fins and the coupling rod are formed using the resin materials of different types. Further, the formation is performed in a state where one surface of the coupling rod in the thickness direction is in contact with the end face of each fin main body.

In the meantime, the coupling rod extends in the alignment direction of the fins. For this reason, the melted resin formed to have a shape of the coupling rod by a metallic mold is more shrunken in a longitudinal direction of the coupling rod than in the other direction when it is cooled and cured. When the shrinkage amount is different between the adjacent coupling holes and the interval between the coupling holes is not uniform, an axis line of the coupling pin is not parallel among the plurality of fins, the sliding resistance between the fin main body and the coupling rod is not uniform, and the operation feeling is deteriorated when tilting the fin.

Regarding this, when the void portion is formed between the adjacent circular disc portions of the rod main body, like the above configuration, the void portion absorbs the shrinkage in the longitudinal direction during the cooling and curing of the melted resin. By the absorption, the non-uniformity of the shrinkage amount of the melted resin between the adjacent coupling holes is suppressed. The non-uniformity of the interval between the adjacent coupling holes is reduced, the non-uniformity of the sliding resistance between the fin main body and the coupling rod is reduced, and the operation feeling upon the tilting operation of the fin is improved, as compared to a configuration where there is no void portion.

The void portion may be formed at a place adjacent to the circular disc portion of the rod main body.

According to the above configuration, the action of the void portions suppressing the shrinkage of the melted resin is made at places of the rod main body adjacent to the circular disc portions. For this reason, the non-uniformity of the interval between the coupling holes is reduced. The non-uniformity of the sliding resistance between the fin main body and the coupling rod is suppressed, and the operation feeling upon the tilting operation of the fin is improved, as compared to a configuration where the void portions are formed at places distant from the circular disc portions.

Also, the shrinkage of the melted resin is suppressed in the vicinity of the circular disc portion, and an influence of the shrinkage on the shape of the circular disc portion is reduced, so that the circular disc portion is formed to have a shape closer to a circular shape. For this reason, the contact area between the fin main body and the coupling rod is more constant, irrespective of the angle of the fin main body relative to the rod main body. That is, when the fin is tilted, the contact area is more difficult to change and the sliding resistance to be generated between the fin main body and the coupling rod is more constant. As a result, the situation where the operation load upon the tilting operation of the fin changes depending on the inclination of the fin is more difficult to occur.

The void portion may be located on a virtual line of the rod main body extending in the alignment direction.

According to the above configuration, the action of the void portions suppressing the shrinkage of the melted resin is made on the virtual line of the rod main body extending in the alignment direction of the fins. For this reason, the non-uniformity of the interval between the coupling holes is reduced. The non-uniformity of the sliding resistance between the fin main body and the coupling rod is suppressed. The operation load upon the tilting operation of the fin is more stable, as compared to a configuration where the positions of the void portions in the width direction of the rod main body are not uniform between the adjacent coupling holes.

The circular disc portion provided at an intermediate part in the alignment direction may be sandwiched from both sides in the alignment direction by a pair of the void portion, and the pair of void portion may be formed at places equidistantly spaced from the coupling hole.

According to the above configuration, the circular disc portion provided at the intermediate part in the alignment direction is sandwiched from both sides in the same direction by the pair of void portions. The action of both the void portions suppressing the shrinkage of the melted resin is made at places equidistantly spaced from the coupling hole. For this reason, the non-uniformity of the interval between the coupling holes is reduced. The non-uniformity of the sliding resistance between the fin main body and the coupling rod is suppressed. The operation load upon the tilting operation of the fin is more stable, as compared to a configuration where the distances of the pair of void portions, which is configured to sandwich the circular disc portion, from the coupling hole is different.

According to the register for air-conditioning, it is possible to improve the operation feeling when tilting the fin.

What is claimed is:

1. A register for air-conditioning comprising a plurality of fins aligned in a direction intersecting with a flow direction of air for air-conditioning, in a retainer having a flow path of the air for air-conditioning, each of the fins including: a plate-shaped fin main body for changing the flow direction; a fin shaft protruding from the fin main body and configured to tiltably support the fin main body to the retainer; and a coupling pin protruding in parallel with the fin shaft from an end face of the fin main body, the coupling pin rotatably inserted in a coupling hole of a coupling rod extending in an alignment direction of the fins, the coupling rod being in contact with the end face of each fin main body, wherein the coupling rod includes a rod main body extending in the alignment direction, the coupling rod includes a circular disc portion which has a diameter larger than a width of the rod main body and which is provided around the coupling hole, and both side parts of the circular disc portion in a width direction of the rod main body protrude from the rod main body toward both sides in the width direction, and the fins and the coupling rod are formed by different types of resin materials in a state where one surface of the coupling rod in a thickness direction is in contact with the end face of each fin main body, and a void portion is formed between adjacent two of the circular disc portion of the rod main body.

2. The register for air-conditioning according to claim 1, wherein the void portion is formed at a place adjacent to the circular disc portion of the rod main body.

3. The register for air-conditioning according to claim 2, wherein the void portion is located on a virtual line of the rod main body extending in the alignment direction.

4. The register for air-conditioning according to claim 3, wherein the circular disc portion provided at an intermediate part in the alignment direction is sandwiched from both sides in the alignment direction by a pair of the void portion, and the pair of void portion are formed at places equidistantly spaced from the coupling hole.

5. The register for air-conditioning according to claim 1, wherein the void portion is located on a virtual line of the rod main body extending in the alignment direction.

6. The register for air-conditioning according to claim 5, wherein the void portion is one of a plurality of void portions, one of the circular disc portions is provided at an intermediate part in the alignment direction and is sandwiched from opposite sides in the alignment direction by a pair of the void portions, and the void portions of the pair are formed at places equidistantly spaced from the coupling hole.

* * * * *